US009475554B2

(12) United States Patent
Heimerl

(10) Patent No.: US 9,475,554 B2
(45) Date of Patent: Oct. 25, 2016

(54) CONVERTIBLE SEATING APPARATUS AND SYSTEM OF USE

(71) Applicant: Robert Lee Heimerl, Sheboygan, WI (US)

(72) Inventor: Robert Lee Heimerl, Sheboygan, WI (US)

( * ) Notice: Subject to any disclaimer, the term of this patent is extended or adjusted under 35 U.S.C. 154(b) by 0 days.

(21) Appl. No.: 14/727,615

(22) Filed: Jun. 1, 2015

(65) Prior Publication Data

US 2016/0264217 A1 Sep. 15, 2016

Related U.S. Application Data

(63) Continuation-in-part of application No. 14/644,837, filed on Mar. 11, 2015, now Pat. No. 9,428,249.

(51) Int. Cl.
*B63B 29/04* (2006.01)

(52) U.S. Cl.
CPC ..... *B63B 29/04* (2013.01); *B63B 2029/043* (2013.01); *B63B 2029/046* (2013.01)

(58) Field of Classification Search
CPC ..... B63B 29/04; B63B 2029/043
USPC ..... 114/362–364
See application file for complete search history.

(56) References Cited

U.S. PATENT DOCUMENTS

| | | | | |
|---|---|---|---|---|
| 4,191,388 | A * | 3/1980 | Barksdale | B60R 3/02 182/91 |
| 4,722,419 | A * | 2/1988 | Hoszowski | B63B 27/14 114/362 |
| 8,028,641 | B1 * | 10/2011 | Sly | B63B 27/146 114/362 |
| 2009/0301378 | A1 * | 12/2009 | Walbridge | B63B 29/04 114/363 |
| 2010/0319604 | A1 * | 12/2010 | Mayrand | B63B 29/02 114/363 |
| 2013/0312653 | A1 * | 11/2013 | Hinson | B63B 17/00 114/363 |

* cited by examiner

*Primary Examiner* — Lars A Olson
*Assistant Examiner* — Jovon Hayes
(74) *Attorney, Agent, or Firm* — Mandy L. Tran; Ceres Patent & Technology LLC

(57) ABSTRACT

A seating apparatus and system having dual application for above deck and below deck use. The device is hingely attached to the ledge of a deck by an anchor wherein said device rotates between upward and downward position. Additional elements may be attached to said device for convertible above and below deck purposes. One or more device may be adjacently positioned along the deck edge to form a recreational deck environment.

11 Claims, 5 Drawing Sheets

CONVERTIBLE SEATING APPARATUS AND SYSTEM OF USE

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

CROSS REFERENCE

This continuation in part patent application claims benefit of and incorporates by reference in its entirety the prior filed nonprovisional utility patent application, Application Ser. No. 61/985,090.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

1. Field of the Invention

The present matter relates to a convertible seating device for above and below deck side use.

2. Background

In the industry of recreational equipment for water related activities, devices and equipment are typically engineered for their narrow purpose of use. For example, a deck ladder is designed specifically for ingress and egress between a body of water and deck surface. Water submersed seating is designed to achieve the singular affect of comfortable seating while wading in water. Deck side furnishing is designed for deck side use. Dual purpose equipment does exist having multiple functionalities. For example, U.S. patent application Ser. No. 13/465,306 describes a device that converts between a single bench seat and a dual bench and table device. U.S. Pat. No. 8,366,124 describes a beach cart that converts to a table and containment system. What remains lacking in the industry are devices and equipment that have a cross-over quality, capable of engaging in both above deck and below water activities, between two or more different kind of environment. A possible reason why there is a scarcity of devices that cross over between below water and above deck use is because consumers have failed to recognize an environment capable of supporting this dual function. Primarily out of concern over safety, our culture consciously avoids products that encourage extensive use of space along a deck ledge adjacent to a body of water. Culturally, use of this space involves a great deal of protective measures provided by protective equipment (i.e. guard rails, life preservers, etc.) or by regulatory means (presence of life guards, limited access and warning signs). Devices that encourage activity along a deck ledge involve certain risk of liability. In the industry of water related recreation, the preference is to limit liability by encouraging and limiting water related risk to normal scope of use within the water environment. As such this particular environment in the recreational industry has historically been overlooked.

There exists a vast unexplored area within the realm of art pertaining to cross over recreation between above deck and below water activity. Products that bridge the two environments and create new cross over experiences must consider both safety and comfort for the user in these two opposite types of environment. It is not enough to utilize existing devices for either above deck or underwater application. Not only do the alternative environments involve different engineering concerns, but an intermediate environment is exists along the location where the dual application device is situated. Therefore, an ideal experience must involve consideration of the above deck, below water and intermediate environments.

BRIEF SUMMARY OF THE INVENTION

An invention is directed herein to a seating apparatus and system having dual application for above deck and below deck use. In particular, the invention relates to a seating device that enables one or more individual users to be seated below deck submersed partly above and below water level. Alternatively, the same seating device may be rotated upward above deck in locking position, for use as above deck rest support (i.e. counter and or seating space). The device and system herein contemplates positioning along the edge of a deck. One or more device may be adjacently positioned along the deck edge to form a recreational deck environment.

The broad intention of this invention is to establish a deck side recreational environment where an individual may rest in suspended manner from the side of a deck or rest above the deck surface enjoying a particular view. Further enjoyment of the deck side environment derived from this device is in having the option to switch between multiple environments (surface to water) while enjoying a restful experience (i.e. in relaxed seated position). From a recreational standpoint, a user may swim up to the seating device in lowered position, rest on the seat without having to continue wading, and enjoy other more restful activities while seated in the water. The device may be used by a pool deck, boat deck or by a wharf at a beach. The deck itself may comprise any stable surface that is raised above ground level, including a boat deck, waterside dock, wharf, pool side deck, etc. The deck need not be adjacent to a body of water and the invention herein can be used in alternative recreational environments (non-water related) according to its inherent features.

The device herein is designed in such a way to enable a user to be seated facing forward or rearward from deck side when the device is in a lowered position. A gap of space between the device and the side wall of the deck is necessary to allow for leg room if a user chooses to sit facing deck side. This may be desirable if the user interacts with deck side activities. Such activities may include eating and drinking, table games, reading, etc. Another consideration is with proper height adjustment when the device is in its raised or lowered position. Adjustability along the length of the device allows accommodation of each user's body size and height. To be able to enjoy submersion in water while having freedom to engage in non-water related activities would require the water surface be located somewhere by the user's waist line and no higher than the user's shoulder line. This way, the space above the user's waist line would be above water, allowing items to be placed on a tray or on the deck surface located above the user's waist for non-water related activities. Height adjustability of the device will be a necessary feature if universality is considered in the design as each deck side environment will vary (distance between deck surface and water surface) as well as individual body proportions (location of a user's waist line). Multiple height options may be provided in non-height adjustable versions of this device.

The convertible seating apparatus for above and below deck side use of this invention comprises a vertical support having a top end and a bottom end. The vertical support comprising durable material of any shape or form that is load bearing and corrosion resistant in all weather water environments (saline, chlorinated, etc.). One or more horizontal platform is attached to and extends from the bottom end of the vertical support. The horizontal platform having a surface area sufficient to accommodate and bear the weight of an individual seated thereon or accommodate placement of items. An additional (a second) horizontal platform may be added, extending from the vertical support parallel to the first horizontal platform in rearward or juxtaposed manner, towards either direction. The second horizontal platform may serve as a table top or arm rest when the device is used in lowered position or alternatively as a seat support in upward position. Rearward positioning of the second horizontal platform away from the first horizontal platform helps to avoid obstructing the user's body who is seated on the lower first horizontal platform.

The vertical support is attached to an anchoring means at its top end. The anchoring means serves to securely attach the device onto the ledge of a deck surface. In lowered position, the anchoring means is able to bear a leveraging load of users seated at the opposite end of the device. The anchoring means should further contemplate the ability to rotate the device towards an upward above deck position with minimal handling of the anchoring mechanism or the device itself. This may be accomplished by an adjustable or rotatable gear mechanism such as but not limited to a worm or beveled gear. This type of gear mechanism allows the device to rotate along its vertical support at the location of the anchoring means and lock into place at the preferred position. The device would not have to be removed to change between above deck or below deck option. The anchoring means may comprise a gear held within a gear housing, said gear housing boltable to the deck surface. Alternatively, the deck surface may have fitted receiver holes that receives and lock onto the device in removable fashion. The range of rotation around the anchoring means is preferably within 360 degrees along the vertical axis such that the device may be attached and lowered or raised on both left side and right side deck ledge. A narrower range of movement may be acceptable when designed for a known platform environment. In any case, the device should be rotatable between a lowered position and an upper raised position at its gear driven anchoring means, preferably within a 180 degrees radius. The gear mechanism should further have a locking means that is load bearing to securely maintain position of the device while it is in use. Alternatively, the anchoring means may comprise a non-gear manner of adjustment wherein said vertical support would rotate downward towards a bottom vertical abutment, fixing said vertical support at the preferred position. Said vertical may rotate upward towards a top vertical abutment, locking in place with a locking pin or similar device. For a fixed non-rotatable anchoring version of this device, the anchoring means may be specially designed to be removed and manually rotated or flipped by 360 degrees to switch between anchoring preferences for above deck or below deck use.

An important aspect of this device lies in the angle of protrusion of the device from its vertical support and the location of the anchoring means, particularly when in use. This angle feature is enabling to both the device and the claimed system. The vertical support of the device, when positioned on the horizontal surface of a deck ledge, would extend outward in lowered position at a slight angle below 0 from the horizontal plane. The purpose of the angle bears importance when the device is in lowered position. The angle provides a natural gap between the vertical support and the side surface of the deck to give leg room for an individual seated facing deck side. In upward position, the angle may lean inward towards the deck, establishing a safe distance between the user and the deck ledge. In the upward position, the angle may alternatively extend out near to or beyond the ledge of the deck for purposes of maximizing deck space. This is an important attribute in managing boat space. The angle may be designed into the device between the anchoring means and the first horizontal platform. Accordingly, the anchoring means would be planarly positioned on the surface of a deck ledge wherein the vertical support extends outward and downward at a fixed predetermined angle. In the case of an adjustable rotatable anchoring means involving a gear mechanism for 360 vertical axis rotation, locking features can be integrated into the gear mechanism or the gear box to lock the vertical support at a preferred angle of extension to adjust the angle of space in either upward or lowered position. This provides the greatest flexibility for universal application wherein a single device may be adjusted to different types of deck environments, individual preferences and for left side or right side use. Having the angle begin at the attachment point of the anchoring means allows the vertical support to have a straight design. A straight design of the vertical support would allow integration of a telescoping feature for height adjustability.

Alternatively, the angle may comprise one or more angled bends between the top and bottom end of the vertical support along the vertical support. Having an angled bend on the vertical support decreases the sharpness of the angled gap between the side wall surface of the deck side and the seated individual. A user may feel less of the tilt according to this embodiment. Having an angle designed into the vertical support creates a gap of space between the device and the deck side wall while providing a more upright seating experience when the device is in its lowered position. This allows an arm rest (second horizontal platform) to be attached to the device above the seat platform (first horizontal platform) in both rearward and forward position without being in the way of the user seated thereon. An otherwise sharper angle would dictate that the second horizontal platform extend in the direction of the angle (towards the deck side wall) so as to not obstructive to the seated user. The preferred degree of angle between the top end and bottom end of the device in lowered position should be enough to provide leg room to the user seated thereon facing deck side. This may be any range of space at an angle above 0 to 90 degrees from horizontal along the vertical plane.

In the upward position, the device may be position at direct vertical (90 degree from horizontal along the vertical axis) or at a slight angle in either direction from the deck. For those embodiments of devices having only a (one) first horizontal platform, the single platform in upward position would serve as an arm rest. The user would be seated on a separately provided stool. For those embodiments of devices having two horizontal platforms, the second horizontal platform (serving as an arm rest in the lowered position) would serve as a seat in the upward position. Conversely, the first horizontal platform (serving as a seat support in the lowered position) would serve as an arm rest in the upward position.

The device may comprise a series of cross bars, woven or nonwoven material, flat panels, plates or similar durable material and design features fitting the particular purpose. Additional features may be added or attached to the device. In particular, additional horizontal platforms in the form of cross bars may be horizontally attached to the vertical support. In the upward position, the cross bars extend a horizontal distance above the deck ledge dually serving as a guard rail or foot rest. In the downward position, the cross bars may serve as a back rest for individuals seated facing away from the deck side. Additional features include the option of a second horizontal platform which dually serves as an arm rest or table top in lowered position and a seat support in upward position. Given that a new area of art is created for deck side recreation, additional activities will naturally cultivate around this device and system. Accessories not listed herein that are attachable to this device are thus contemplated within the scope of this invention.

The system of this invention further contemplates a detachable version of this device that can be stored or relocated. More than one of said apparatus may be adjacently positioned alongside a deck surface edge to create a recreational seating environment that dually serves as a convertible water seating area and a guard rail along the length of said deck ledge. The device may comprise a single complete component unit comprising a vertical support, a horizontal platform and an anchor. Multiple singular units may be interconnected to form a length of said devices in a recreational system. Alternatively, the separate elements of the device may be modularized in that the user would have the option to construct and design the unique apparatus of this invention by interconnecting one or more vertical support elements, one or more horizontal platforms and one or more anchoring means. The individual elements may take a variety of form but conforming to the claimed standards of this invention.

Yet another embodiment of this invention contemplates electrical controls integrated into the device that connect with a boat engine system as an added safety feature. The boat engine would automatically switch off and be disabled when the device is rotated to a lowered position. This may be a desirable safety option to avoid movement of the boat while the device is in a lowered position and a person is seated thereon. The engine would be reactivated or enabled when the device is raised to its upward position. According to this system, the boat would convert to a nonnavigable platform when the device is in its lowered position and transition back to a navigable watercraft when the device is in its upright raised position.

The core feature of this invention as described and claimed may be combined with additional elements to enhance and broaden user options. Other features, advantages, and object of the present invention will become more apparent and be more readily understood from the following detailed description, which should be read in conjunction with the accompanying drawings.

DETAILED DESCRIPTION OF THE INVENTION

The invention herein pertains to a convertible seating apparatus that is intended to be used alongside the ledge of a deck surface. The device is securely positioned along a deck ledge, dually rotatable between an upward and lowered position for above and below deck use. In lowered position, a user is seated in suspended manner deck side, preferably partially submersed in water for recreational purposes. In upward position, the device would conversely serve as a resting area, providing a platform for arm rest, foot rest or seating. Additional features may be added to the device for convertible application between upward and lowered positional use.

Figure 1:
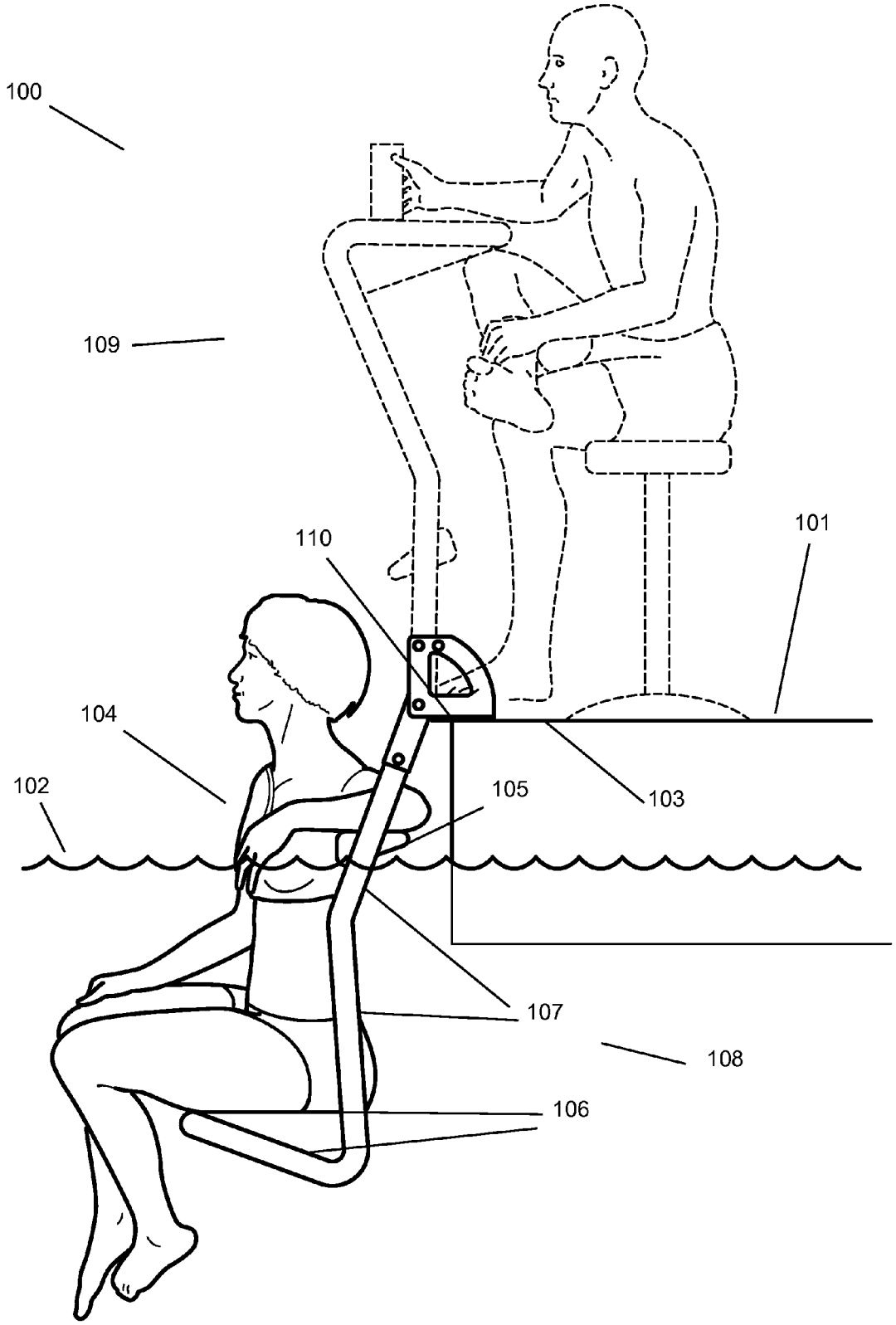
FIG. 1 is a side plan view of a preferred embodiment of the invention herein for boat side or wharf side use.

FIG. 1 illustrates the device 100 according to boat side, wharf side or pier dock 101 application. These such applications typically involve a waterline 102 located a distance below the deck surface 103. At times within 12 inches or greater, depending on the depth of the water body or the design of the boat. A wharf or pier deck 101 is designed to be raised above the ground surface by a distance that would place the deck surface 103 near flush to the level of a boat deck. The purpose is to make it easier for an individual to step from the boat onto the pier deck. It is safe to assume that in many cases, the waterline 102 is located at an approximate similar distance from a boat deck as from a pier or wharf dock. In these cases, the user's upper body 104 (typically the part of a person's body above the waist line) would be positioned substantially below the boat deck or pier deck surface 103 and would find little practical advantage of using the boat deck or docking area 103 as an arm rest. In this application, a second horizontal platform 105 may be attached rearward and parallel to the first horizontal platform 106 along the vertical support 107 to serve as an arm rest for the user in the lowered position 108. The device in the upward position 109 is either perpendicular to or slightly angled away from the edge of the deck surface 103. According to FIG. 1, the device extends slightly outward beyond the ledge 110 of the deck surface 103, maximizing available deck space.

Figure 2:
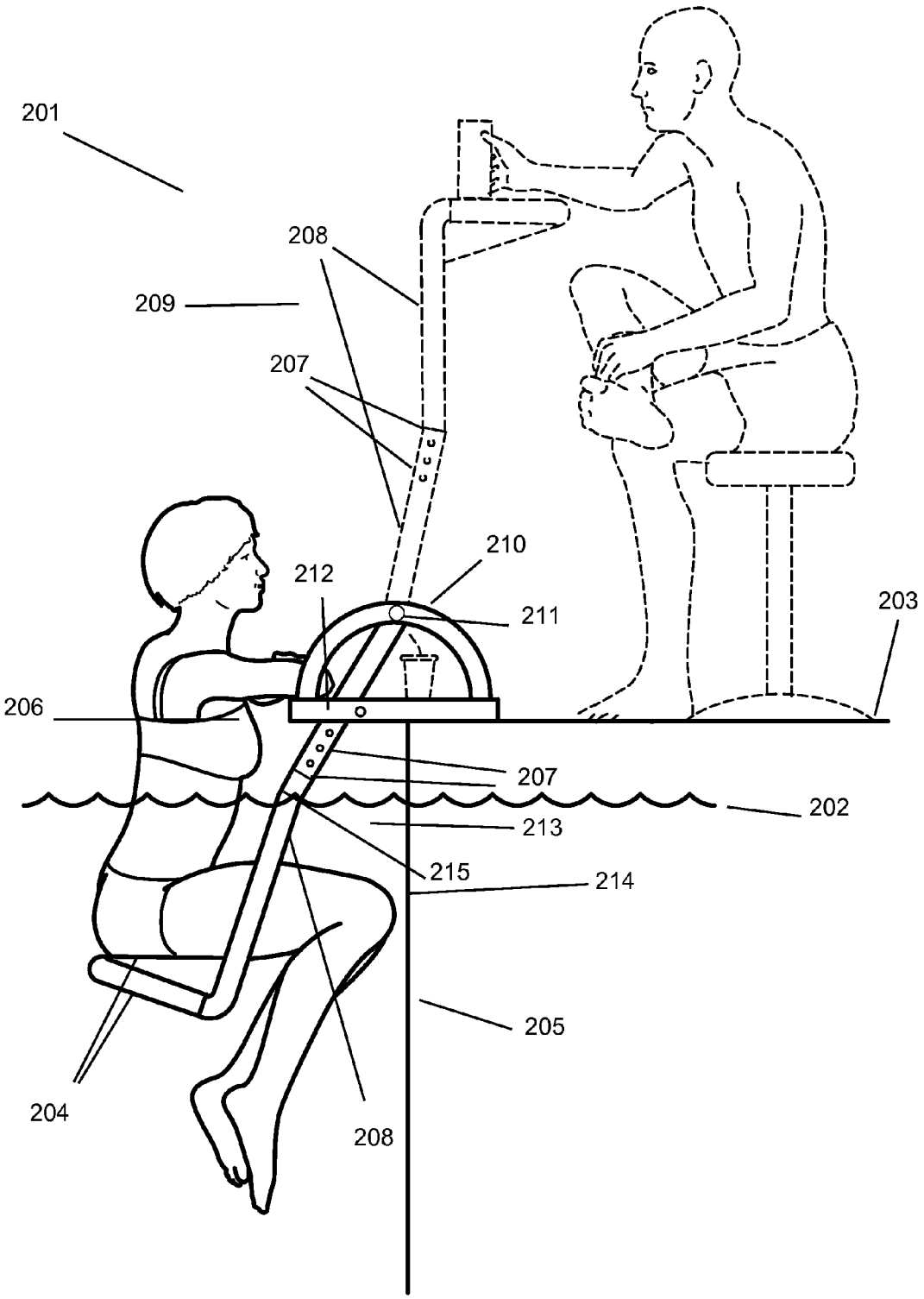
FIG. 2 is a side plan view of a preferred embodiment of the invention herein for pool side use.

FIG. 2 illustrates the device according to poolside application. A pool side 201 environment typically provides a water line 202 of the pool near the deck surface 203. In some instances for aesthetic purposes, the water line is slightly raised above the deck surface tapering off with the eventual rise of the deck surface. Where the water line 202 is higher and closer to the level of the deck surface 203, the first horizontal platform 204 of the device is preferably positioned at a higher vertical level closer to the top surface of the water. Accordingly, a user seated on the first horizontal platform 204 in its lowered position 205 would have his or her chest 206 positioned above the water line 202 and be able to take advantage of the deck surface 203 as an arm rest or table top. An adjustable feature 207 of the vertical support 208 comprising interlocking nested tubing 207 enables the device 200 to be adjusted to the user's height preference in the lowered 205 and upward position 209. According to this particular embodiment, the anchoring means 210 of the device comprises a vertical support 208 rotatable around a horizontal shaft 211, which abuts against a second horizontal platform 212 at the base of the anchoring means 210. The second horizontal platform 212 having grooves cut through the platform (not shown in the illustration) to abut against the vertical support 208 in lowered position 205. The grooves terminate at a choice location to create a desired angle of space 213 between the vertical support 208 and side of the deck 214. This is a hybrid system wherein the device 200 is rotable around the anchoring means 210 between upward 209 and lowered position 205, and is further lockable in position but does not utilize a worm gear mechanism. The second horizontal platform 212 also serves as an arm rest or table top for use in lowered position 205. According to FIGS. 1-2, the angle of space or protrusion 213 of the vertical support 208 away from the deck side wall 214 is established by an angled bend 215 integrated near midway on the vertical support 208. The user seated thereon would be positioned in a more natural upright position.

Figure 3:
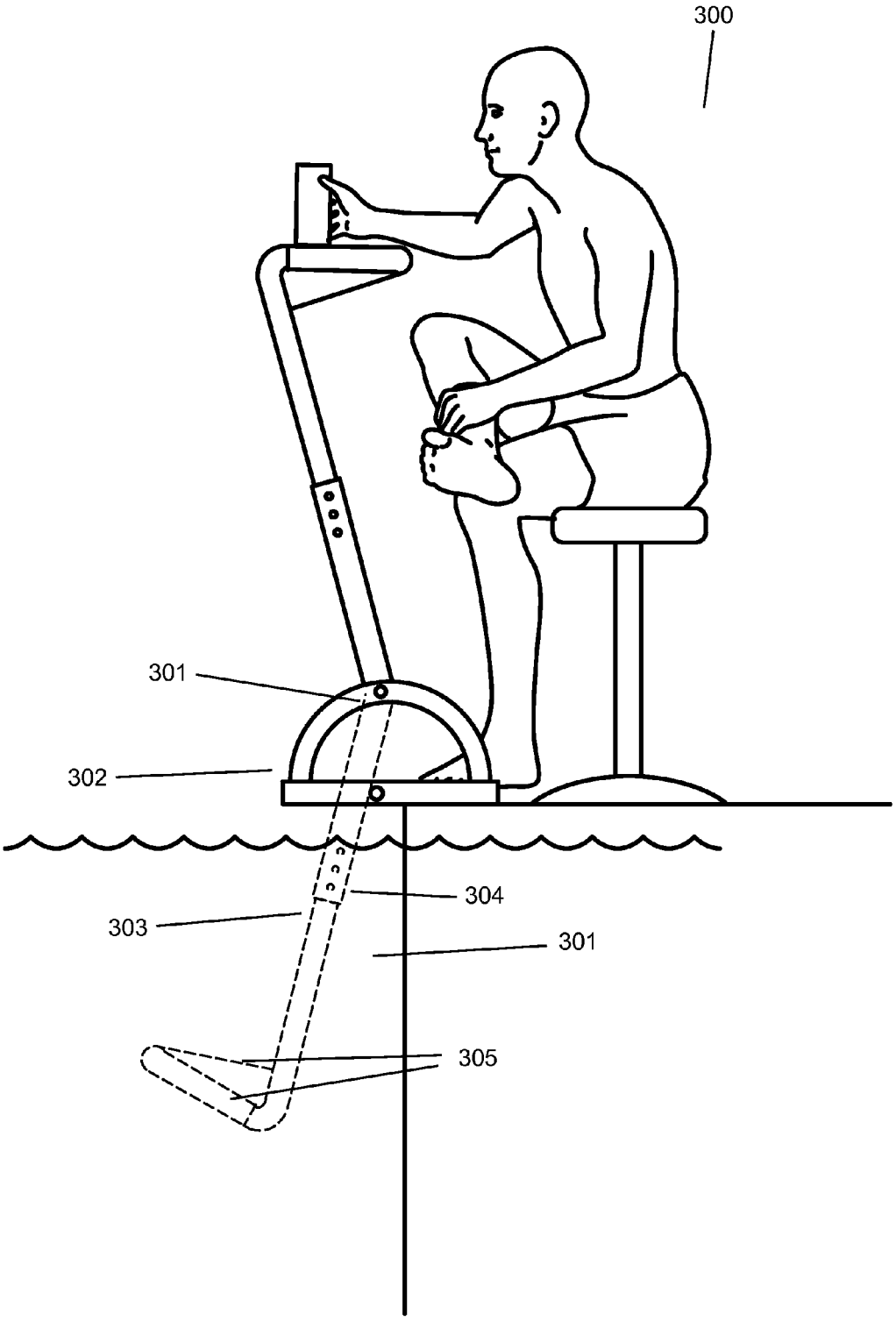
FIG. 3 is a side plan view of an alternatively embodiment of the invention herein for pool side use.

FIG. 3 provides an alternative embodiment of the device 300 for poolside application. According to this embodiment, the angle of protrusion 301 begins at the anchoring means 302 and the vertical support 303 is completely straight. The straight design of the vertical support 303 provides freedom to manufacture adjustable nesting features 304 along any location of its length. There would be no interference by a bend. The drawback would be a slight tilt to the user seated thereon. The tilt may be corrected by adjusting the angle of attachment between the first horizontal platform 305 and the vertical support 303.

Figure 4:
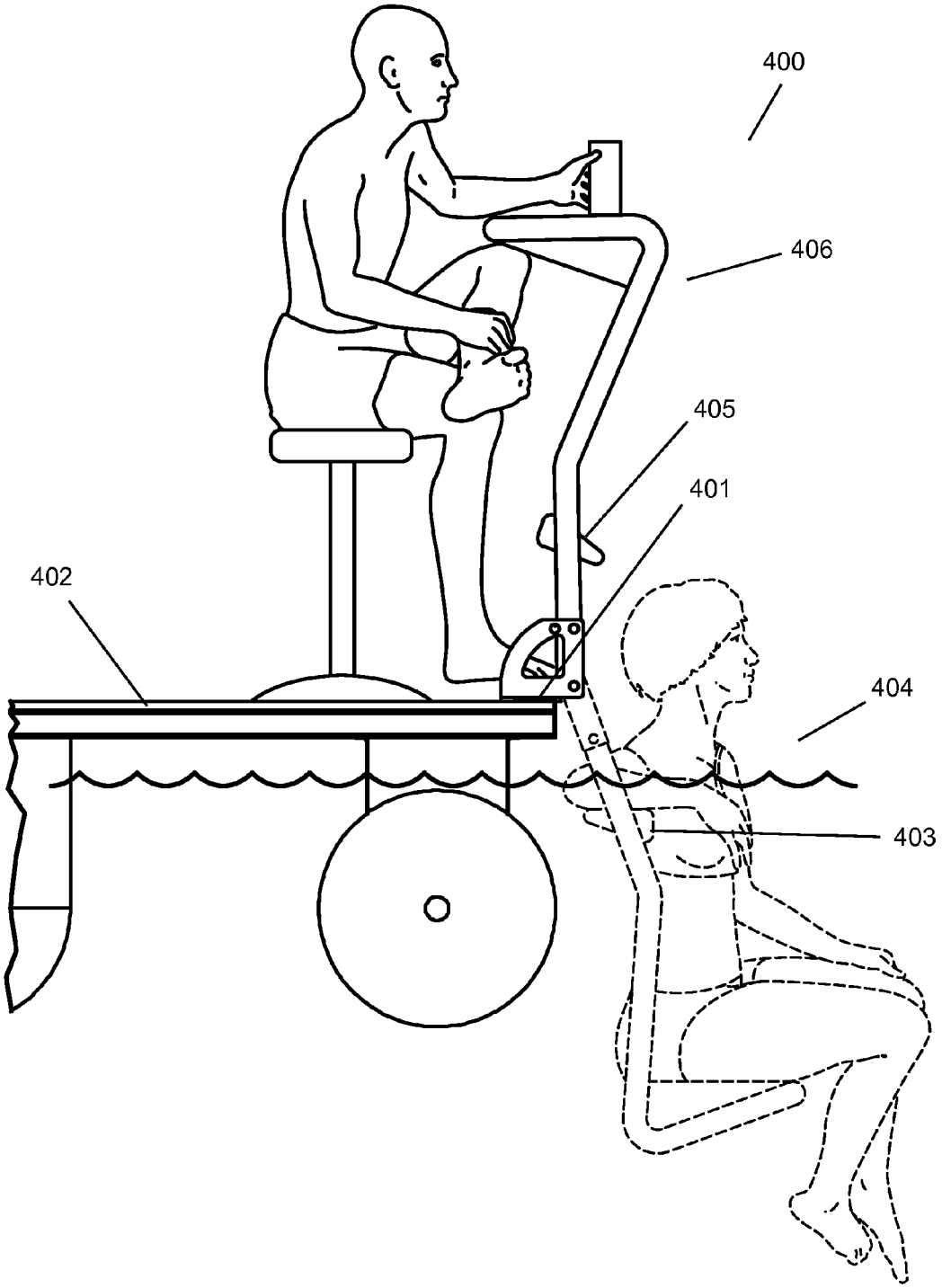
FIG. 4 is a side plan view of an alternative embodiment of the invention herein.

FIG. 4 provides a side plan perspective of the device 400 applied boat side along the ledge 401 of a pontoon boat deck 402. The second horizontal platform 403 serves as an arm rest in the lowered position 404 and dually as a foot rest or guard rail 405 in the upward position 406. The device 400 is positioned furthest towards the deck ledge 401 and protruding slightly outward to maximize use of deck space on the boat. The features of the device 400 according to this illustration is proportional in both lowered 404 and upright position 406 such that little to no adjustment of height is required to accommodate a typical sized adult user between 5 feet to 6 feet in height.

Figure 5:
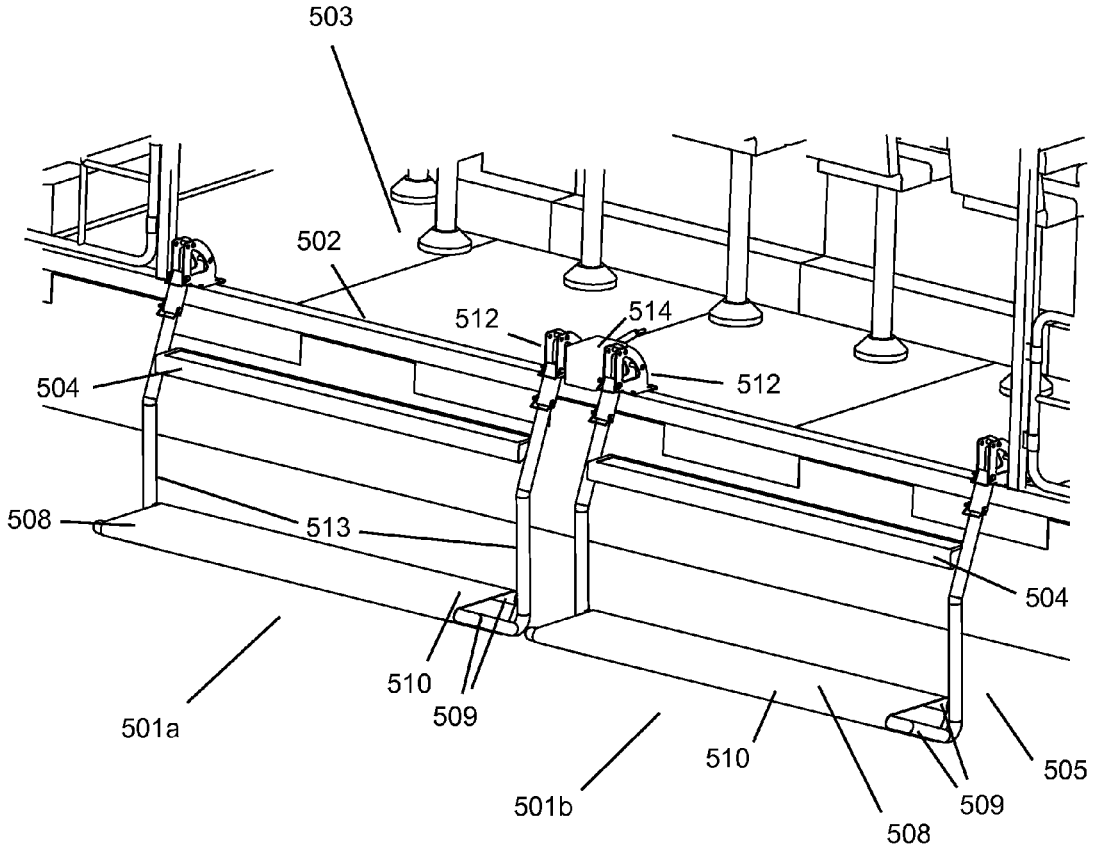
FIG. 5 is a side plan view of a preferred embodiment of the invention herein for boat side use.

FIG. 5 provides a front perspective view of the device 501*a* positioned side by side with another 501*b* of the same along the ledge 502 of a pontoon boat deck 503. The second horizontal platform 504 serving as an arm rest in the lowered position 505 dually serves as a guard rail in the upright position. The first horizontal platform 508 comprising a combination of solid bars 509 surrounded by sewn, plastic or rubber material 510. The vertical support 513 should be long enough to extend below the waterline in this scenario. The anchor system 512 may be connected to the engine by electrical wires held within an electrical box 514 wherein the engine would be disabled when the device is in lowered position 505 to avoid injury. The engine would be enabled when the device is converted to upright position and the guardrail is locked in place. This may be achieved by any known means in the industry.

Having fully described at least one embodiment of the present invention, other equivalent or alternative methods according to the present invention will be apparent to those skilled in the art. The invention has been described by way of summary, detailed description and illustration. The specific embodiments disclosed in the above drawings are not intended to be limiting. Implementations of the present invention with various different configurations are contemplated as within the scope of the present invention. The invention is thus to cover all modifications, equivalents, and alternatives falling within the spirit and scope of the following claims.

I claim the following:

1. A seating apparatus comprising:

one or more vertical support, each said vertical support having a top end and a bottom end, a horizontal platform attached to and extending from said bottom end, said top end attached to an anchoring system, said bottom end positioned forward from said top end, each said vertical support positionable from said anchoring system at an angle, each said vertical support is rotatable within 360 degrees along a vertical plane at its said top end by its said anchoring system.

2. The seating apparatus of claim 1 having an angled bend between its said top end and its said bottom end.

3. The seating apparatus of claim 1 wherein each said vertical support having an adjustable length.

4. The seating apparatus of claim 1 wherein a first and second horizontal platform is attached to and extends from a vertical support, said first horizontal platform positioned at said bottom end, said second horizontal platform positioned rearward from and above said first horizontal platform.

5. The seating apparatus of claim 1 connectable to an engine disabling means of a watercraft device.

6. A convertible seating system for a deck platform comprising a convertible seating device according to claim 1, said anchoring system of said convertible seating device positioned at the edge of a deck platform, said vertical support extending away from said anchoring system and said deck at an angle, said angle is adjustable by rotating said vertical support at said anchoring means.

7. Said convertible seating system of claim 6 wherein said convertible seating device positioned at the edge of said deck is positionable in an upward position for above deck use and lower position for below deck use by rotating said vertical support along said anchoring means within 360 degrees and locking said vertical support in place at said anchoring means.

8. Said convertible seating system of claim 6 wherein a gap of space is provided between said convertible seating device in lowered position and said deck by positioning said vertical support forward and away at an angle from sand anchoring system and said deck.

9. Said convertible seating system of claim 6 wherein said convertible seating device is positionable in upward position above said deck, providing rest and barrier support.

10. Said convertible seating system of claim 6 wherein support elements are configurable by attaching components to said vertical support in coordinated manner for a supporting affect, said components comprising lengths of bars, flat panels, interconnecting links, woven or nonwoven materials or combinations thereof.

11. Said convertible seating system of claim 6 wherein said convertible seating device is interconnected with the power source of a watercraft device, disabling said power source when said convertible seating device is in a lowered position.

* * * * *